US009613510B2

(12) United States Patent
Buckley

(10) Patent No.: US 9,613,510 B2
(45) Date of Patent: Apr. 4, 2017

(54) APPARATUS AND METHOD FOR RAPID HUMAN DETECTION WITH PET IMMUNITY

(71) Applicant: Honeywell International Inc., Morristown, NJ (US)

(72) Inventor: Mark C. Buckley, Pollock Pines, CA (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 338 days.

(21) Appl. No.: 13/759,837

(22) Filed: Feb. 5, 2013

(65) Prior Publication Data

US 2014/0218195 A1 Aug. 7, 2014

(51) Int. Cl.
*G08B 13/196* (2006.01)
*G08B 13/19* (2006.01)

(52) U.S. Cl.
CPC ..... *G08B 13/19606* (2013.01); *G08B 13/19* (2013.01)

(58) Field of Classification Search
CPC ..... G08B 13/19606; G08B 13/19
USPC ..... 340/541, 545.1; 348/155; 382/143, 224
See application file for complete search history.

(56) References Cited

U.S. PATENT DOCUMENTS 3,702,998 A * 11/1972 Lucas ..... G08B 13/1663 340/552
4,710,750 A * 12/1987 Johnson ..... G08B 13/19 340/522
5,276,427 A * 1/1994 Peterson ..... G08B 13/2494 340/506
7,738,008 B1 6/2010 Ball
2001/0004400 A1* 6/2001 Aoki et al. ..... 382/107
2004/0119819 A1* 6/2004 Aggarwal et al. ..... 348/143
2006/0045354 A1* 3/2006 Hanna et al. ..... 382/224
2012/0098662 A1* 4/2012 Lee et al. ..... 340/545.1
(Continued)

FOREIGN PATENT DOCUMENTS

JP 5-64198 3/1993
JP 5-328355 12/1993
JP 2000-258552 9/2000

OTHER PUBLICATIONS

Combined Search and Examination Report for corresponding GB application 1401114.2, dated Jul. 25, 2014.

*Primary Examiner* — Hai Phan
*Assistant Examiner* — Royit Yu
(74) *Attorney, Agent, or Firm* — Husch Blackwell LLP

(57) ABSTRACT

A method and apparatus are provided, wherein the apparatus performs the steps of detecting a moving object within a secured area, determining a size of the moving object, determining that the size exceeds a predetermined size threshold value associated with an animal, determining an aspect ratio of the moving object, determining that the aspect ratio meets a predetermined aspect ratio threshold value associated with an animal or crawling human, but not an upright human, retrieving an indicator from memory that establishes whether an animal is present or not present within the secured area, and setting an alarm upon detecting that the moving object exceeds the predetermined size threshold value, that the determined aspect ratio meets the predetermined aspect ratio threshold value of an animal or crawling human, and that the indicator establishes that there is no animal present in the secured area.

20 Claims, 2 Drawing Sheets

(56) References Cited

U.S. PATENT DOCUMENTS

2012/0327241 A1* 12/2012 Howe ..... 348/155

* cited by examiner

APPARATUS AND METHOD FOR RAPID HUMAN DETECTION WITH PET IMMUNITY

FIELD

The field of the invention relates to security systems and, more particularly, to security systems that accommodate pets.

BACKGROUND

This application is related to U.S. patent application Ser. No. 13/168,198 filed on Jun. 24, 2011 and assigned to the same assignee as the instant application.

Security systems are well known. In the case of a home, a security system is usually controlled from a panel placed proximate an exit to the home. In this case, the proximity to the exit is intended to make it convenient for a homeowner to arm or disarm the system via the control panel as he/she exits or enters the home.

Once armed, the control panel may monitor the sensors placed on a periphery of the home in order to detect an intruder opening a door or window. Upon detecting an intruder, the control panel may send an alarm message to a central monitoring station.

In addition to detecting intruders along the periphery, one or more interior sensors may have a motion detection capability to detect intruders who have defeated the door or window sensors. The majority of these interior sensors rely on changes in infrared energy in the room, Passive Infrared (PIR) sensors, or a combination of PIR and microwave Doppler shift (known as Dual Tecs) sensors. However, motion detection devices can generate false alarms when the homeowner has a pet. Accordingly, a need exists for better methods of detecting motion that avoid the problem of false alarms due to the presence of pets.

DETAILED DESCRIPTION OF AN ILLUSTRATED EMBODIMENT

Figure 1:
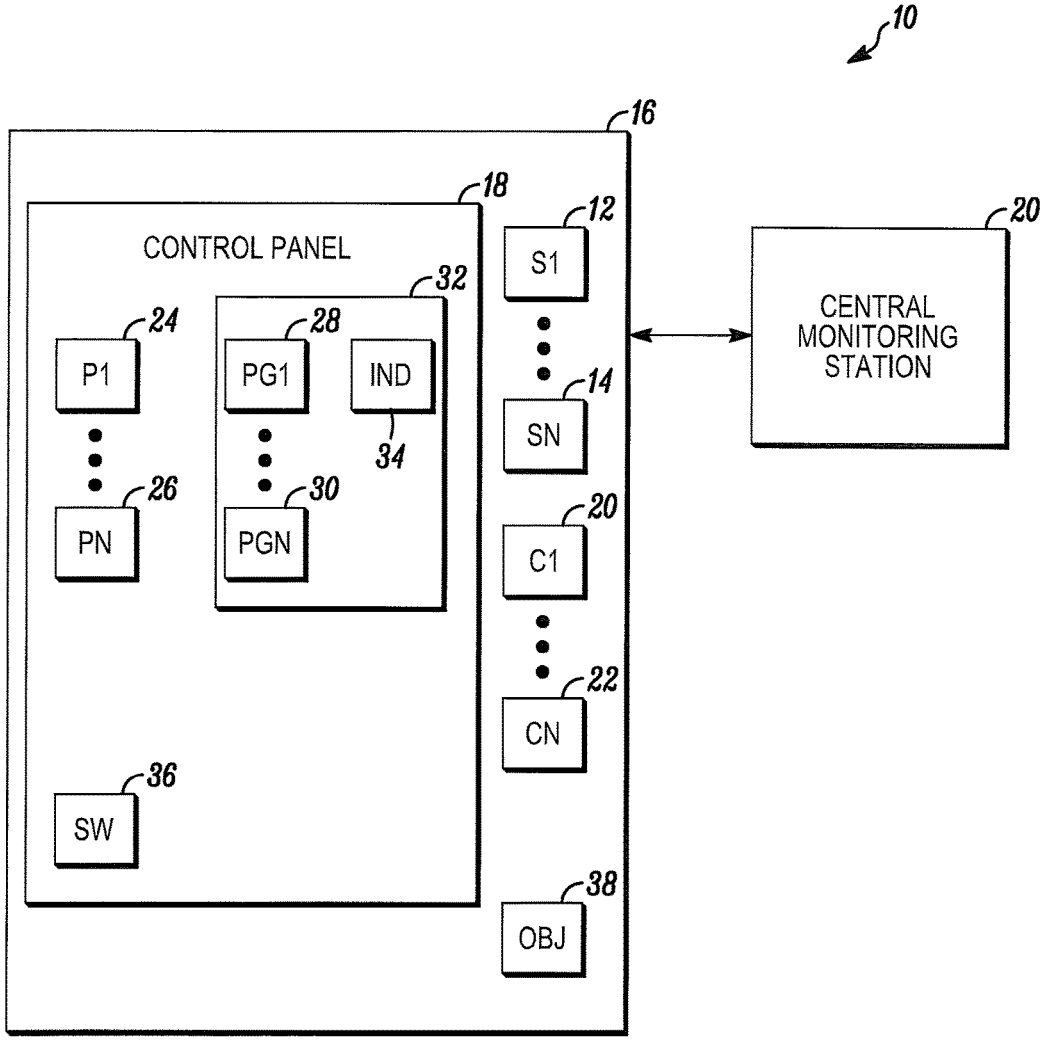
FIG. 1 is a block diagram of a security system shown generally in accordance with an illustrated embodiment.

While embodiments can take many different forms, specific embodiments thereof are shown in the drawings and will be described herein in detail with the understanding that the present disclosure is to be considered as an exemplification of the principles hereof as well as the best mode of practicing the same. No limitation to the specific embodiment illustrated is intended.

In general, there are many prior art intrusion detectors that are advertised to be pet immune. These sensors are advertised to issue alarms in the presence of a human while ignoring dogs of up to 100 pounds in size. However, these sensors are perceived by many end users and professionals in the industry to either generate false alarms when a large dog is moving in the protected area or to miss issuing an alarm when a human is moving in the protected area. These sensors will not issue an alarm if a human crawls through the protected area.

FIG. 1 is a block diagram of a security system 10 that solves these problems shown generally in accordance with an illustrated embodiment. Included within the system may be one or more sensors 12, 14 that monitor for security threats. The sensors may be limit switches placed on portals (e.g., doors, windows, etc.) that allow entry into or egress from a secured area 16. They may be acoustic detectors that generate an alarm when they receive the sound signature of a window breaking. They may be PIR or Dual Tec sensors that detect movement within the protected area.

The sensors may also include one or more sensors that detect environmental hazards. For example, at least some of the sensors may detect smoke or natural gas.

The sensors may be monitored by a control panel 18. Upon activation of one of the sensors, the control panel may send an alarm message to a central monitoring station 20. The central monitoring station, in turn, may summon the police.

Included within the control panel may be one or more processor apparatuses (processors) 24, 26 operating under control of one or more computer programs 28, 30 loaded from a non-transitory computer readable medium (memory) 32. As used herein, reference to a step performed by a program of the system is also a reference to the processor that executed that step.

Also included within the system are one or more cameras 20, 22. The cameras may be used to monitor the periphery of the secured area or an interior of that area for security threats.

In one preferred embodiment, the cameras are sensitive to and collect images in the visible spectrum of 390-750 nm as well as the near infrared spectrum of up to 900 nm. In an even more preferred embodiment, the cameras are also sensitive to and collect images in the IR spectrum, which extends from 1.4 to 1,000 μm. These cameras are typically sensitive in the mid and long wavelength infrared regions (3-8 μm and 8-15 μm, respectively) and are commonly referred to as microbolometers and, alternatively, thermal imagers.

Included within each of the cameras (or panel) may be an image processor that processes successive frames of video from the camera for the detection of motion within a field of view of the camera. In this regard, the image processor may compare successive images to detect moving objects within the successive frames based upon changes in corresponding pixel values between the successive frames.

In addition to detecting motion, the image processor (or a separate object size processor) may process pixel areas with detected changes in order to determine a size of the moving object. In this regard, the size of the moving object may be determined from a height of the camera above the floor, from an angle of the camera with respect to the horizon, and by a calibration process in which a person of known height walks from a position directly beneath the camera to a distant end of a field of view of the camera.

In general, the size of the moving object may be determined via the appropriate processor by first forming a bounding box around the moving object based upon the change in pixel values between successive frames. Next, a distance of the moving object from the camera may be determined from the distance of the bottom of the bounding box to the bottom of the field of view of the camera.

Once the distance of the moving object from the camera has been determined, a height and width of the moving object can be determined by another set of processors. The height may be determined from the angle subtended by the top and bottom of the bounding box and by the number of pixels within that angle. Width may then be determined from a simple proportionality factor by comparing the number of pixels of height with the number of pixels in width of the bounding box.

Similarly, the motion of the object may be determined based upon the determined distance and the relative motion of the bounding box. In one case, the motion of the moving object may be determined to be oscillatory if the motion is centered about some particular fixed position. If not, then the motion may be determined to be either random or intentional based upon the overall direction of the moving object. If intentional, then the speed, in feet per second, may be determined from the distance and number of pixels per second traversed by the moving object.

Once a size is determined, an aspect ratio may be determined. In this case, the aspect ratio may be defined by the height divided by the width.

Once the size and aspect ratio are determined, this information may be used to further classify the moving object. For example, the aspect ratio may be used in conjunction with the size to identify the type of moving object (e.g., standing human, crawling human, animal, etc.). The size may also be used to estimate the weight based upon the type of moving object, but this may be done merely to evaluate risk. For example, the surface area of a 60 lb. dog would be below the surface area of a potentially threatening human. A very small child is not typically considered threatening.

Further processing via one or more of the processors may be used to identify the type of threat involved. For example, moving objects having the aspect ratio of a human may be further processed to identify a torso, head, arms, and legs of the human. These further processing methods may be used to confirm the type of threat involved.

In general, the size, type, and speed of the moving object may be determined using one or more or the processes described in U.S. patent application Ser. No. 13/168,198 incorporated by reference as if fully set forth herein. The further processing used to confirm the type of threat may also be performed using one or more of the methods of the incorporated application.

Under one preferred embodiment, the further processing may be avoided using the process and apparatus set forth below. In this way, the utility of the security system is dramatically improved by the decrease in the time required to detect human intruders.

In general, the speed of the security system of FIG. 1 in detecting intruders is increased and the number of false alarms is reduced via the use of a pet indicator 34 saved in the memory 32. The indicator may have a first value (e.g., "1") in the case where a pet is present in the secured area and another value (e.g., "0") where there is no pet present within the secured area.

Under one illustrated embodiment, the indicator may be controlled via a switch (e.g., a DIP switch) 36 located within or on the panel 18. The switch may have a label indicating "normal security" where a pet is present and "high security" where there is no pet present within the secured area.

In this case, the normal security setting would mean that a dog over about 60 pounds is present in the house. Alternatively, in the normal security setting, and rather than setting a switch 36, the system may be "allowed to learn" that a pet is present in the house and react accordingly.

Figure 2:
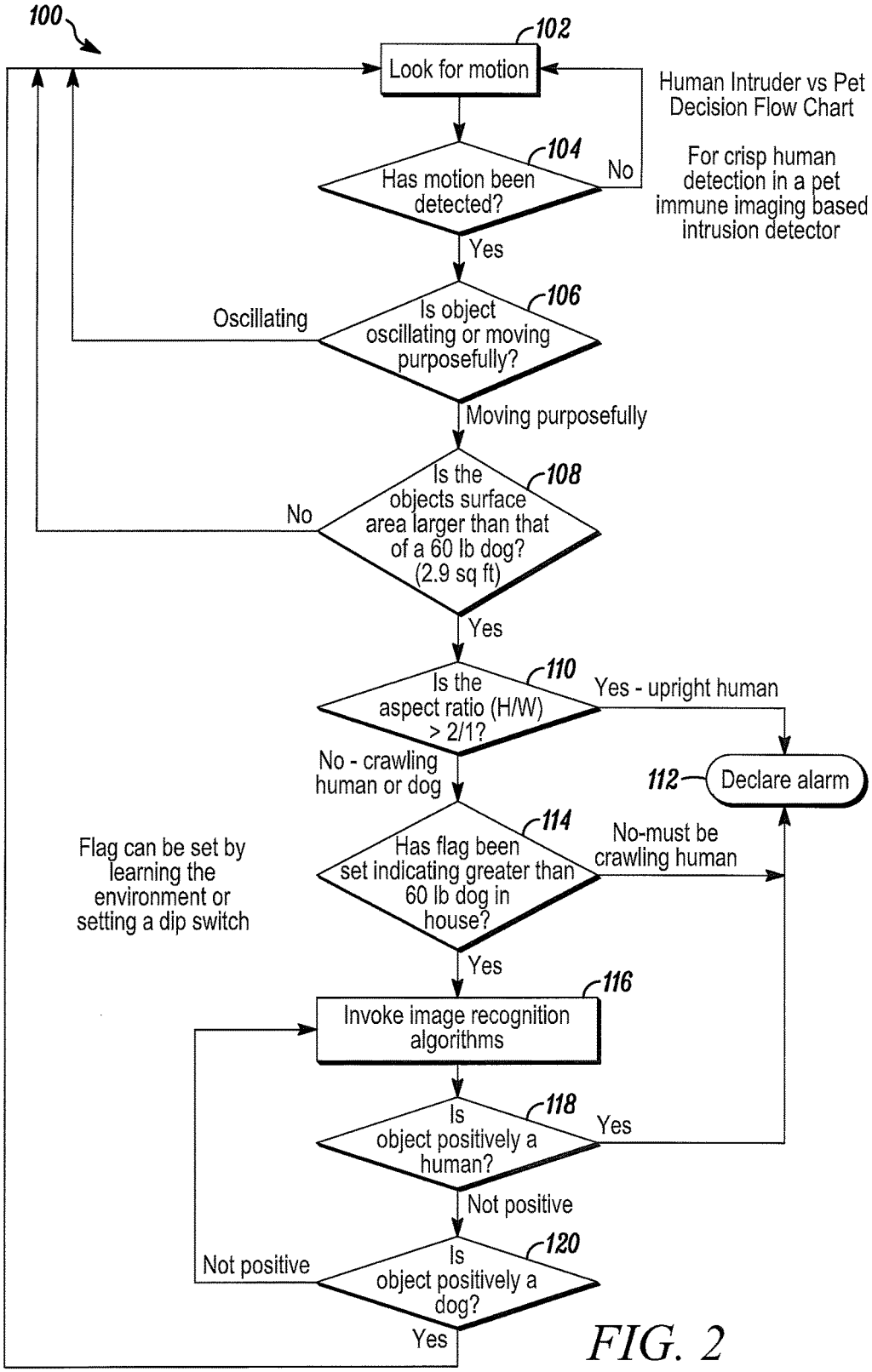
FIG. 2 is a flow chart of steps that may be performed by the system of FIG. 1.

FIG. 2 depicts a set of steps 100 that may be performed by the system of FIG. 1. FIG. 2 also depicts signal flow among one or more of the processors of FIG. 1.

During normal operation, a video processor may examine successive frames from the cameras in order to look for or otherwise detect motion 102. If no motion is detected 104, then the system takes no action.

On the other hand, if motion is detected 104, then the detected motion is processed by one or motion processors to detect 106 if the motion is purposeful or not. If the motion is oscillatory, then no action is taken.

If the motion is purposeful, then an associated size processor determines 108 whether the size of the moving object 38 is greater than some threshold value. In this case, the predetermined size may be the projected surface area of a 60 pound dog or 2.9 square feet.

If the moving object is greater than the minimum size, then an aspect processor determines an aspect ratio of the moving object and whether the determined aspect ratio is greater 110 than some predetermined aspect ratio threshold value (e.g., >2:1). If the aspect ratio is greater than the predetermined aspect ratio threshold value (and greater than the minimum size), then an alarm is declared 112.

If not, then the moving object must be a crawling human or a dog. As such, processing of the data for the moving object continues.

As a next step, an indicator processor determines 114 whether the indicator in memory has been set. If the indicator has not been set (indicating that there is no dog in the premises), then an alarm is immediately declared 112.

If the indicator has been set indicating that a pet of sufficient size is in the facility and permitted to move in the area protected by the camera, then the moving object could still be a crawling human or a dog. As such, processing of the data for the moving object continues.

Next, an algorithm processor invokes 116 one or more further processing routines (processors) as described in U.S. patent application Ser. No. 13/168,198 to determine if the moving object is a crawling human or a dog. For example, a human image processor may process the data of the moving object to identify the torso, the head, and/or the arms and the legs of a human. If the moving object can be positively identified 118 as a human, then an alarm is declared 112.

If the moving object cannot be positively identified as a human at this time, then one or more animal image processors may continue processing the data from the moving object to positively identify a dog. In this case, the animal image processor may attempt to identify the head and the ears, the elongated torso, and the associated legs of the dog via the data and the characteristic features of dogs. It may also attempt to identify the foot and leg motion of a dog walking and that of a human crawling as the two are quite different and distinctive.

If the moving object can be positively identified 120 as a dog, then (under one embodiment), an indicator processor may examine the settings of the switch 36. If the setting is in a normal security mode, then the processor may save the indication of a dog present in the premises (e.g., a "1") in the memory indicator location 34. The processor may also save a size of the dog. If not, then the process may simply repeat.

By allowing the process to repeat, the system avoids the necessity of declaring an alarm when the moving object may simply be an animal. In addition, by repeating the iterations of the flow chart 100, the results may be more conclusive during the next iteration. For example, by repeating the iteration, the delay allows the moving object to turn (e.g., from a front view to a side view) in such a way as to allow the body shape to be more conclusively identified as a human or an animal.

In addition, by saving the indication of the presence of the dog or the indication of the presence of the dog and the size of the dog, the number of false alarms can be reduced. This is especially the case in step 110 of FIG. 2 where the determination is made that there is a dog present within the area and the size of the moving object is compared with the saved size of the dog.

The ability to declare an alarm at step 110 significantly reduces the processing time between detection of the moving object and declaring of the alarm. The determination that a dog is present in the secured area when the size of the dog matches the size of the dog saved in the indicator allows the processing of steps 116, 118, and 120 to be avoided.

In general, the system avoids the processing of steps 116, 118, and 120 in the case where a dog of a certain size is present. If not, then the steps 116, 118, and 120 are executed anyway.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

The invention claimed is:

1. A method comprising:

examining a switch and saving an indicator that an animal is present or not present within a secured area;

detecting a moving object within the secured area;

determining a size of the moving object;

determining that the size exceeds a predetermined size threshold value associated with the animal;

determining an aspect ratio of the moving object;

determining that the aspect ratio meets a predetermined aspect ratio threshold value associated with the animal or a crawling human, but not an upright human;

retrieving the indicator from memory that establishes whether the animal is present or not present within the secured area;

analyzing the moving object to determine if the moving object is the animal when the indicator indicates that the animal is not present in the secured area; and setting an alarm upon detecting that the moving object exceeds the predetermined size threshold value, that the aspect ratio meets the predetermined aspect ratio threshold value associated with the animal or the crawling human, and that the indicator establishes that the animal is not present in the secured area.

2. The method as in claim 1 further comprising discarding the moving object when the moving object oscillates about a stationary location.

3. The method as in claim 1 wherein saving the indicator that the animal is present or not present within the secured area in the memory further comprises determining a position of the switch.

4. The method as in claim 1 further comprising processing pixels defining the moving object to positively identify the moving object as the animal.

5. The method as in claim 1 further comprising saving a positive identification of the animal in the memory as the indicator that the animal is present in the secured area.

6. The method as in claim 1 further comprising processing pixels defining the moving object to positively identify the moving object as the crawling human and setting the alarm.

7. The method as in claim 1 wherein the predetermined aspect ratio threshold value further comprises 2:1 in height to width.

8. A apparatus comprising:

a processor that detects a moving object within a secured area;

a processor that determines a size of the moving object and that the size exceeds a predetermined size threshold value associated with an animal;

a processor that determines an aspect ratio in height to width of the moving object and that the aspect ratio meets a predetermined aspect ratio threshold value associated with the animal or a crawling human, but not an upright human;

a user selectable switch with a setting that provides an indicator of whether the animal is present within the secured area;

a memory that saves the indicator based on the setting of the user selectable switch, wherein the indicator establishes whether the animal is present or not present within the secured area;

a processor that analyzes the moving object to determine if the moving object is the animal when the user selectable switch indicates that the animal is not present in the secured area; and a processor that sets an alarm upon detecting that the moving object exceeds the predetermined size threshold value, that the aspect ratio meets the predetermined aspect ratio threshold value of the animal or the crawling human, and that the indicator establishes that the animal is not present in the secured area.

9. The apparatus as in claim 8 further comprising a processor that detects and discards the moving when the moving object oscillates about a stationary location.

10. The apparatus as in claim 8 further comprising a processor that saves the indicator of whether the animal is present or not present within the secured area in the memory based upon a position of the user selectable switch.

11. The apparatus as in claim 8 further comprising a camera that provides video to the processor that detects the moving object.

12. The apparatus as in claim 11 further comprising a processor that processes pixels defining the moving object from frames of the video provided by the camera in order to positively identify the moving object as the animal.

13. The apparatus as in claim 12 further comprising a processor that saves a positive identification of the animal in the memory as the indicator that the animal is present in the secured area.

14. The apparatus as in claim 11 further comprising a processor that processes pixels defining the moving object from frames provided by the camera in order to positively identify the moving object as the crawling human and sets the alarm.

15. The method as in claim 11 wherein the predetermined aspect ratio threshold value further comprises 2:1.

16. A apparatus comprising:

a camera that captures images within a secured area;

a processor that detects a moving object within the images;

a processor that determines a size of the moving object, compares the size with a predetermined size threshold value associated with an animal, and determines that the size exceeds the predetermined size threshold value;

a processor that determines an aspect ratio in height to width of the moving object and that the aspect ratio meets a predetermined aspect ratio threshold value associated with the animal or a crawling human, but not an upright human;

a user selectable switch with a setting that provides an indicator or whether the animal is present within the secured area;

a memory that saves the indicator based on the setting of the user selectable switch that establishes whether the animal is present or not present within the secured area;

a processor that analyzes the moving object to determine if the moving object is the animal when the user selectable switch indicates that the animal is not present in the secured area; and a processor that sets an alarm upon detecting that the moving object exceeds the predetermined size threshold value, that the aspect ratio meets the predetermined aspect ratio threshold value of the animal or the crawling human, and that the indicator establishes that the animal is present in the secured area.

17. The apparatus as in claim 16 wherein the user selectable switch is set by an authorized user to provide the indicator saved in the memory.

18. The apparatus as in claim 16 further comprising a processor that processes the images from the camera over an extended time period to detect a presence of the animal in the secured area and that saves the presence as the indicator in the memory.

19. The apparatus as in claim 16 further comprising a processor that determines the size of the moving object based upon an elevation of the moving object in a field of view of the camera.

20. The method as in claim 16 wherein the predetermined aspect ratio threshold value further comprises 2:1 in the height to the width.

* * * * *